US011256193B2

(12) United States Patent
Yoshihira et al.

(10) Patent No.: US 11,256,193 B2
(45) Date of Patent: Feb. 22, 2022

(54) POWDER TRANSPORT DEVICE, DEVELOPING DEVICE, AND IMAGE FORMING APPARATUS

(71) Applicant: FUJIFILM Business Innovation Corp., Tokyo (JP)

(72) Inventors: Yuki Yoshihira, Kanagawa (JP); Arichika Tanaka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/929,211

(22) Filed: Jul. 15, 2020

(65) Prior Publication Data

US 2021/0216028 A1 Jul. 15, 2021

(30) Foreign Application Priority Data

Jan. 15, 2020 (JP) ..... JP2020-004127

(51) Int. Cl.
*G03G 15/08* (2006.01)

(52) U.S. Cl.
CPC ..... *G03G 15/0891* (2013.01); *G03G 15/0848* (2013.01); *G03G 15/0853* (2013.01); *G03G 15/0889* (2013.01); *G03G 2215/0827* (2013.01); *G03G 2215/0888* (2013.01)

(58) Field of Classification Search
CPC ..... G03G 15/0891; G03G 15/0848; G03G 15/0889; G03G 2215/0827; G03G 2215/0888; G03G 2215/0891; G03G 15/0849; G03G 15/0853; G03G 15/086
See application file for complete search history.

(56) References Cited

U.S. PATENT DOCUMENTS 3,705,644 A * 12/1972 Kawchitch ..... B65G 33/26 198/664
4,187,030 A * 2/1980 Godley ..... B01F 7/0065 198/666
5,541,710 A * 7/1996 Stewart ..... G03G 15/0822 384/147
2015/0268585 A1* 9/2015 Kadowaki ..... G03G 21/105 399/358
2017/0115597 A1* 4/2017 Kawashima ..... G03G 15/0858
2018/0059606 A1* 3/2018 Mugita ..... G03G 15/0853

FOREIGN PATENT DOCUMENTS

JP 2006-098883 A 4/2006

* cited by examiner

*Primary Examiner* — Walter L Lindsay, Jr.
*Assistant Examiner* — Laura Roth
(74) *Attorney, Agent, or Firm* — Sughrue Mion, PLLC

(57) ABSTRACT

A powder transport device includes: a rotation shaft rotatably supported in a container chamber that contains powder; and plural blade members detachably attached to the rotation shaft, the blade members including spiral blades configured to transport the powder in an axial direction of the rotation shaft in response to the rotation shaft rotating.

15 Claims, 10 Drawing Sheets

POWDER TRANSPORT DEVICE, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2020-004127 filed Jan. 15, 2020.

BACKGROUND

1. Technical Field

The present disclosure relates to a powder transport device, a developing device, and an image forming apparatus.

2. Related Art

JP-A-2006-98883 describes a developing device for developing an electrostatic latent image formed on an image carrier with a developer. The developing device includes a housing, a transport member, and a developing roller. The housing can accommodate the developer. The transport member transports the developer. The transport member includes a shaft portion and a blade portion. The shaft portion is rotatably attached to the housing. The blade portion is integrally formed around the shaft portion in a spiral shape. The developing roller causes the developer transported by the transport member to adhere to the image carrier. The blade portion has plural notch portions such that a communication portion spirally extending from one end of the shaft portion to the other end of the shaft portion can be formed.

SUMMARY

Aspects of non-limiting embodiments of the present disclosure relate to reducing the size per blade member as compared with a case where a single blade member is provided.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided A powder transport device including: a rotation shaft rotatable supported in a container chamber that contains powder; and plural blade members detachably attached to the rotation shaft, the blade members including spiral blades configured to transport the powder in an axial direction of the rotation shaft in response to the rotation shaft rotating.

BRIEF DESCRIPTION OF THE DRAWINGS

Exemplary embodiment(s) of the present disclosure will be described in detail based on the following figures, wherein.

DETAILED DESCRIPTION

Next, an exemplary embodiment and an example will be described in more detail with reference to the accompanying drawings. It is noted that the present disclosure is not limited to the exemplary embodiment and the example.

It is also noted that in the following description made with reference to the accompanying drawings, the drawings are schematic and ratios of dimensions or the like of elements are different from actual ones. Illustration of elements and members other than those necessary for the description may be omitted as appropriate for the sake of easy understanding.

(1) Overall Configuration and Operation of Image Forming Apparatus

(1.1) Overall Configuration of Image Forming Apparatus

Figure 1:
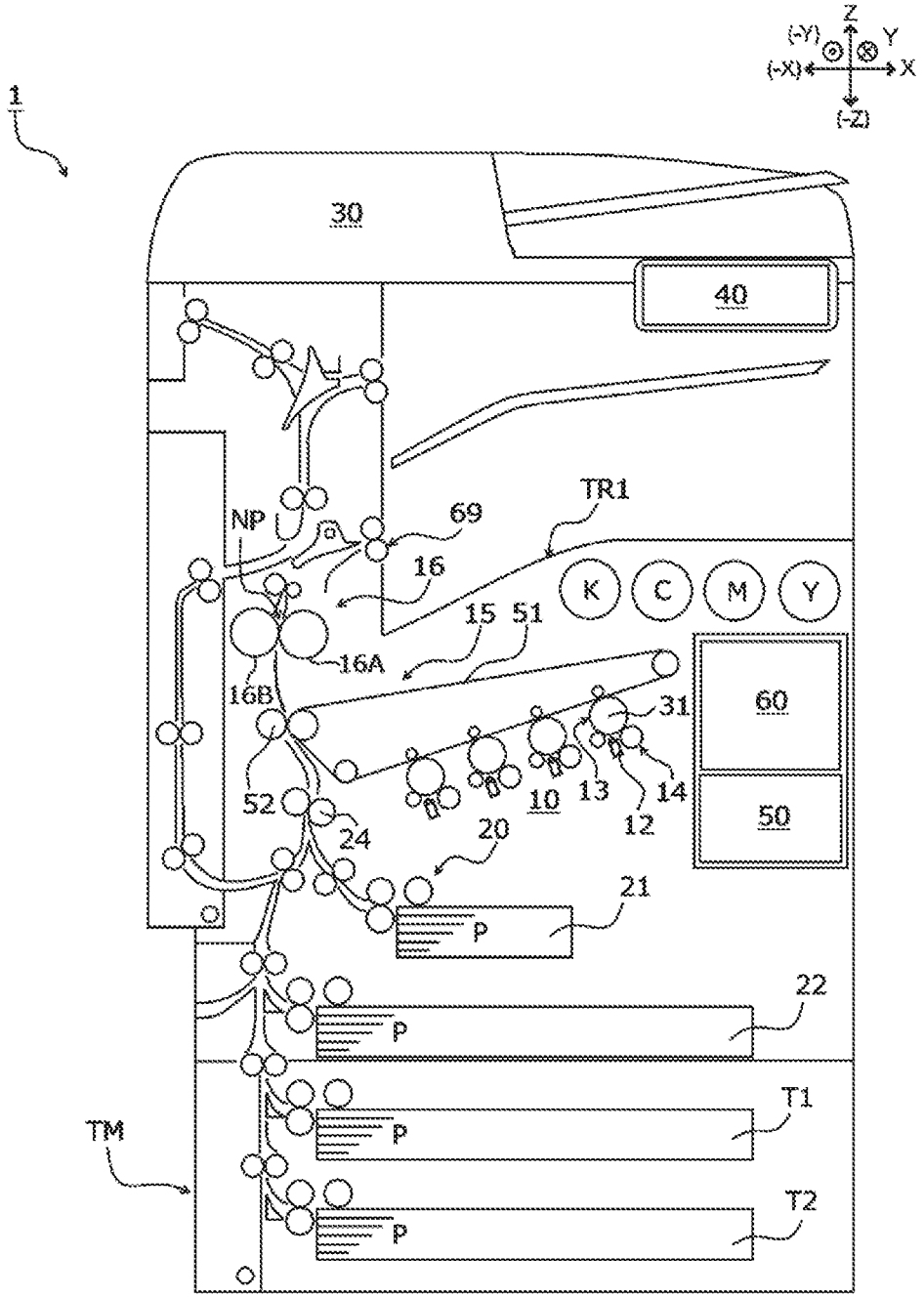
FIG. 1 is a schematic cross-sectional view illustrating an internal configuration of an image forming apparatus.

FIG. 1 is a schematic cross-sectional view illustrating an internal configuration of an image forming apparatus 1 according to the present exemplary embodiment.

The image forming apparatus 1 includes an image forming device 10, a sheet feeding device 20, a reading device 30, an operation display 40, an image processor 50, and a system controller 60. The sheet feeding device 20 is attached to a lower portion of the image forming device 10. The reading device 30 is attached to an upper portion of the image forming device 10. When the image forming apparatus 1 performs a print function or a copy function, an image is formed on a recording medium such as a sheet.

The image forming device 10 includes exposure devices 12, photoconductor units 13, developing devices 14, a transfer device 15, a fixing device 16, and a toner supply device (not illustrated). The image forming device 10 forms a toner image on a sheet fed from the sheet feeding device 20 based on image information received from the image processor 50.

The sheet feeding device 20 including sheet trays 21, 22 is disposed at a bottom portion of the image forming device 10. A tray module TM is disposed below the sheet feeding device 20. The tray module TM includes multiple (two in this exemplary embodiment) sheet trays T1, T2 that are stacked in up and down directions. The sheet trays T1, T2 accommodate sheets. The tray module TM is connected to the image forming device 10 and feeds sheets to the image forming device 10.

The reading device 30 is disposed above the image forming device 10. The reading device 30 reads an image on a sheet by an image sensor (not illustrated) such as a charge coupled device (CCD) line sensor, and converts the image into image data that is electric signals.

The operation display 40 as a user interface is disposed on the front surface of the reading device 30. The operation display 40 includes a combination of a liquid crystal display panel, various operation buttons, and a touch panel. A user of the image forming apparatus 1 inputs various settings and instructions via the operation display 40. Various types of information is displayed on the liquid crystal display panel, for the user of the image forming apparatus 1.

The image processor 50 generates image data based on print information acquired from an external device (for example, a digital camera, a mobile terminal, a personal computer, or the like), and performs various types of image processing using the image data input by the reading device 30.

(1.2) Configuration and Operation of Image Forming Device 10

In the image forming apparatus 1 having the configuration described above, a sheet designated by a print job is sent from the sheet feeding device 20 to the image forming device 10 in accordance with timing of image formation.

The photoconductor units 13 are arranged side by side above the sheet feeding device 20. Each photoconductor unit 13 includes a photoconductor drum 31 that is driven to rotate. Toner images of yellow (Y), magenta (M), cyan (C), and black (K) are formed by the respective developing devices 14 on the respective photoconductor drums 31 on which electrostatic latent images have been formed by the exposure devices 12.

The toner images of the respective colors formed on the photoconductor drums 31 of the photoconductor units 13 are sequentially electrostatically transferred (primarily transferred) onto the intermediate transfer belt 51 of the transfer device 15, so that a superimposed toner image is formed in which the toner images of the respective colors are superimposed. The secondary transfer roller 52 collectively transfers the superimposed toner image on the intermediate transfer belt 51 onto the sheet that is sent by a pair of registration rollers 24 and guided by a transport guide.

In the fixing device 16, a fixing nip portion NP (fixing region) is formed by a pressure-contact region between a heating module 16A and a pressure module 16B.

The sheet on which the toner image is collectively transferred by the transfer device 15 is transported to the fixing nip portion NP of the fixing device 16 through the transport guide in a state in which the toner images are unfixed. The toner images are fixed by an action of heating and pressurizing by the heating module 16A and the pressure module 16B.

The sheet on which the fixed toner image is formed is guided by the transport guide, is discharged from a pair of discharge rollers 69 to a sheet discharge tray TR1 on an upper surface of the image forming apparatus 1, and is accommodated there.

When duplex printing is performed in an automatic manner, the sheet is reversed and sent to the image forming device 10 again. Then, after a toner image is transferred and fixed to the sheet, the sheet is discharged to the sheet discharge tray TR1.

(2) Functional Configuration and Operation of Image Forming Apparatus

Figure 2:
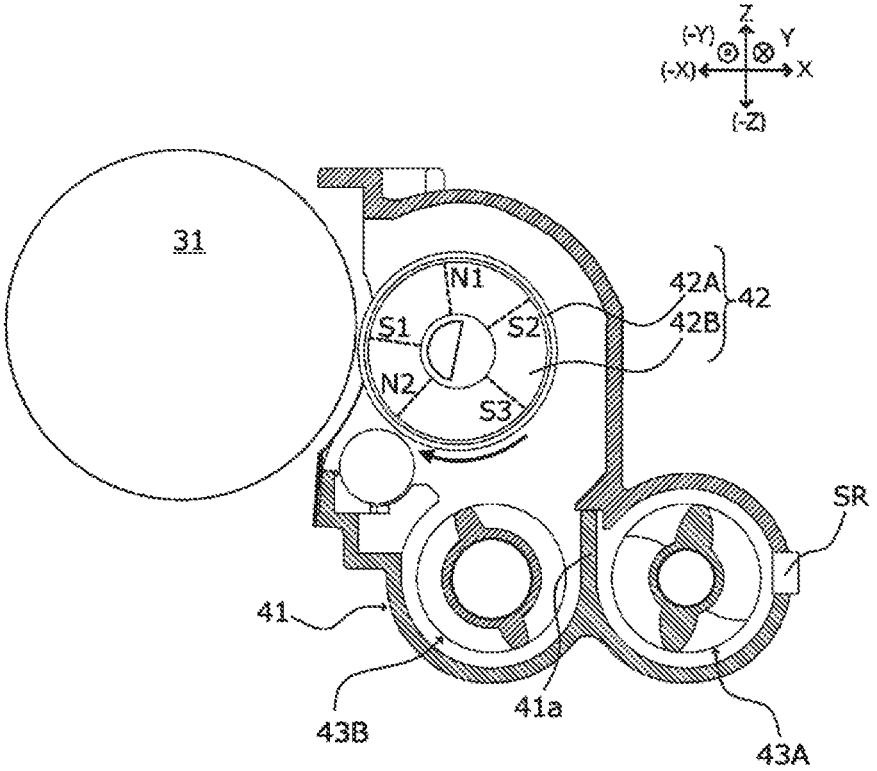
FIG. 2 is a schematic longitudinal cross-sectional view illustrating a configuration of a developing device and a photoconductor drum.
Figure 3:
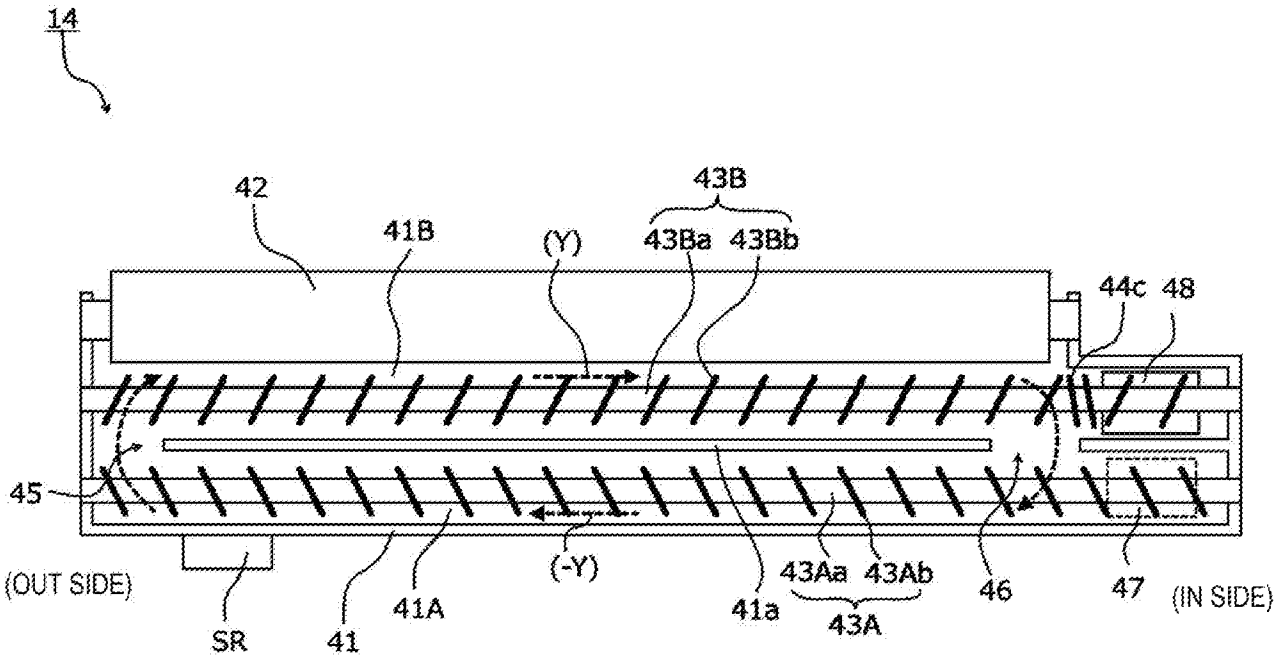
FIG. 3 is a schematic transverse cross-sectional view illustrating how the developer is transported in the developing device.

FIG. 2 is a schematic longitudinal cross-sectional view illustrating a configuration of the developing device 14 and the photoconductor drum 31 in the image forming device 10. FIG. 3 is a schematic transverse cross-sectional view illustrating how the developer is transported in the developing device 14.

(2.1) Developing Device

The developing device 14 includes a developing housing 41, a developing roller 42, an agitation auger 43A, and a supply auger 43B. The developing housing 41 contains a developer. The developing housing 41 is an example of a container chamber. The developing roller 42 faces the photoconductor drum 31. The agitation auger 43A transports the developer while agitating the developer. The agitation auger 43A is an example of a powder transport device, and the developer is an example of powder. The supply auger 43B supplies the developer to the developing roller 42. Hereinafter, the agitation auger 43A and the supply auger 43B may be referred to as "powder transport devices 43" without being distinguished from each other.

The developing roller 42 includes a cylindrical developing sleeve 42A and a magnet 42B. The developing sleeve 42A is supported so as to be rotatable with respect to the developing housing 41. The magnet 42B is a columnar magnet member. The magnet 42B is provided in the inner space of the developing sleeve 42A and fixed to the developing housing 41.

The developing sleeve 42A is configured as follows. That is, the developer is carried on the outer peripheral surface of the developing sleeve 42A by the magnetic force of the magnet 42B, and the developer is transported and supplied to the electrostatic latent image on the photoconductor drum 31 by the rotation of the developing sleeve 42A.

At a developing position, the electrostatic latent image formed on the surface of the photoconductor drum 31 is developed, and the developer after the development is returned to the developing housing 41 by the rotation of the developing roller 42.

In the developing housing 41, a partition wall 41*a* is erected between the agitation auger 43A and the supply auger 43B so as to partition the developing housing 41 into two developer containers 41A, 41B. Openings 45, 46 are formed in both end portions in a longitudinal direction of the partition wall 41*a*.

The agitation auger 434 and the supply auger 433 include spiral blades 43Ab, 43Bb around rotation shafts 43Aa, 43Ba. The agitation auger 43A and the supply auger 43B rotate along the inner walls of the developer containers 41A, 41B in response to receiving of a rotational force from a drive source (not illustrated), so as to transport the developer in predetermined directions in the developer containers 41A, 413.

Specifically, the agitation auger 43A transports the developer in the developer container 41A in an arrow (−Y) direction while agitating the developer. The supply auger 43B transports the developer in the developer container 413 in an arrow (Y) direction while agitating the developer. The developer transported in the arrow (−Y) direction moves to the developer container 41B through the opening 45. The developer transported in the arrow (Y) direction moves to the developer container 41A through the opening 46.

Accordingly, the developer in the developing housing 41 circulates while being agitated by the two augers, that is, the agitation auger 43A and the supply auger 433. Agitating the developer in this manner charges the toner in the developer.

A receiving port 47 is formed in an upper surface at one end portion of the developing housing 41 (in the Y direction, that is, on a rear side of the apparatus). The developing device 14 receives the toner supplied from the toner supply device (not illustrated) through the receiving port 47. The toner received by the developing device 14 through the receiving port 47 is transported by the agitation auger 43A to the developer container 41A of the developing housing 41 and mixed with the developer.

The toner replenished from the toner supply device through the receiving port 47 is transported from the rear side (an IN side, that is, in the Y direction, hereinafter which will be referred to as an "IN side".) to the front side (an OUT side, that is, in the −Y direction, hereinafter which will be referred to as an "OUT side") while being agitated by the agitation auger 43A and is moved to the supply auger 43B at the front side (that is, at the OUT side). Then, the toner supplied from the supply auger 43B is supplied to the developing roller 42.

An auto toner concentration (ATC) sensor SR is disposed in the developing device 14. The ATC sensor SR measures a ratio of the toner to the carrier of the developer circulating in the developing housing 41 (hereinafter, this ratio may be referred to as a "toner concentration" (TC)). The ATC sensor SR is an example of a detector. The ATC sensor SR measures a change in permeability corresponding to the toner concentration (TC) in the developer through a detection surface that is in contact with the developer. The ATC sensor SR detects the toner concentration (TC), for example, by detecting a changing analog output voltage.

In the image forming apparatus 1, a controller instructs toner supply from the toner supply device based on the measurement value obtained by the ATC sensor SR, so that the TC value of the developer is kept at a predetermined value.

In the present exemplary embodiment, the toner is supplied to the developing roller 42 from the OUT side to the IN side. The toner supply amount decreases by the time when the toner reaches the IN side. In order to control the toner supply amount appropriately, the ATC sensor SR is disposed on the OUT side of the agitation auger 43A.

A discharge port 48 is formed at a lower surface of an end portion (in the V direction, that is, at the IN side) of the developing housing 41. A reverse spiral blade 44*c* is disposed upstream of the discharge port 48 in the Y direction. A spiral direction of the reverse spiral blade 44*c* is opposite to that of the spiral blade 43Bb at the other portions. Thus, most of the developer transported in the arrow (Y) direction in the developer container 41B of the developing housing 41 is guided to the opening 46 by the reverse spiral blade 44*c* and moved to the developer container 41A, while a part of the developer goes beyond the reverse spiral blade 44*c* and is discharged to the outside of the developing device 14 through the discharge port 48.

(2.2) Configuration of Powder Transport Device

Figure 4:
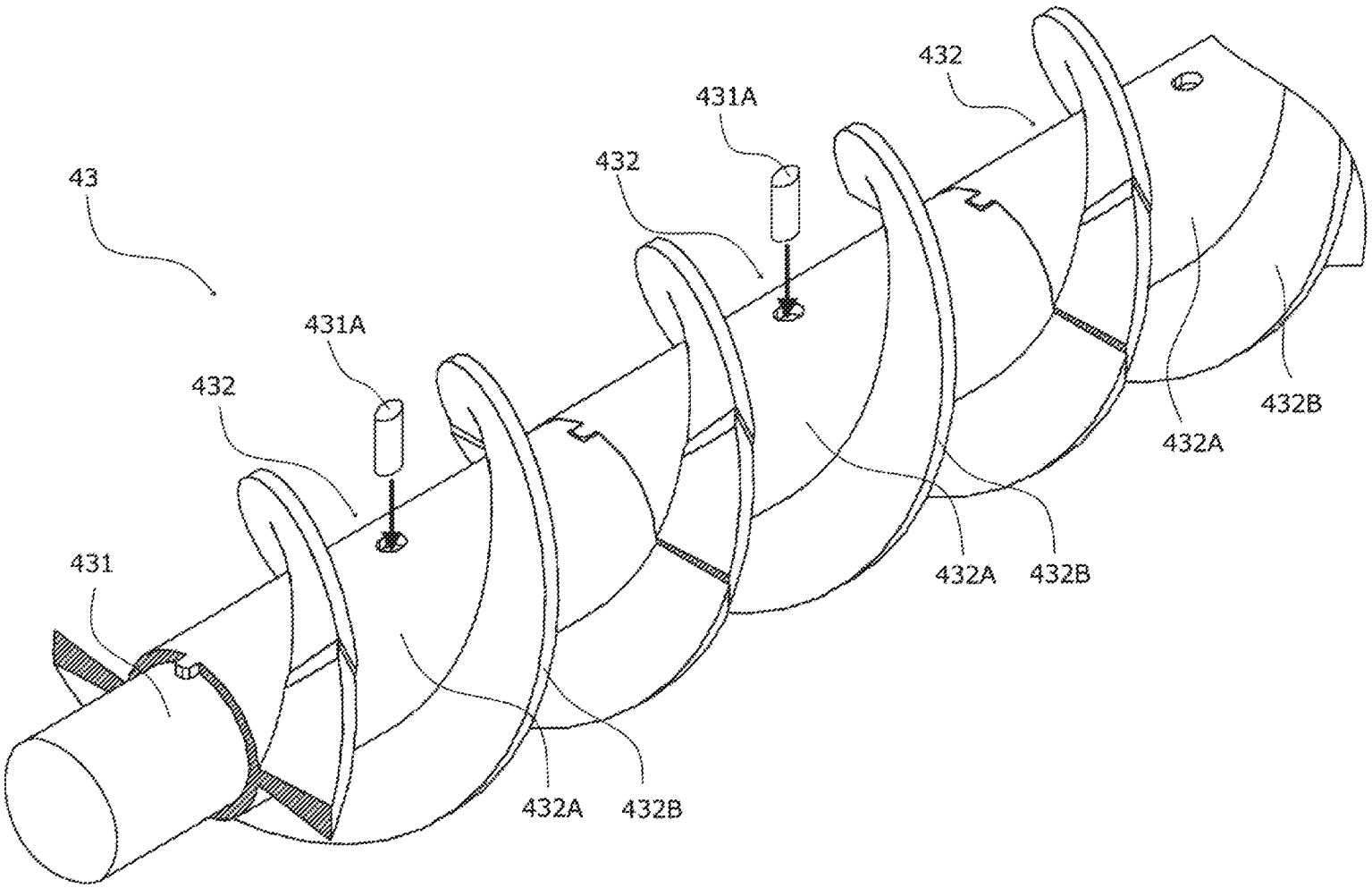
FIG. 4 is a perspective view illustrating a configuration of a powder transport device.
Figure 5:
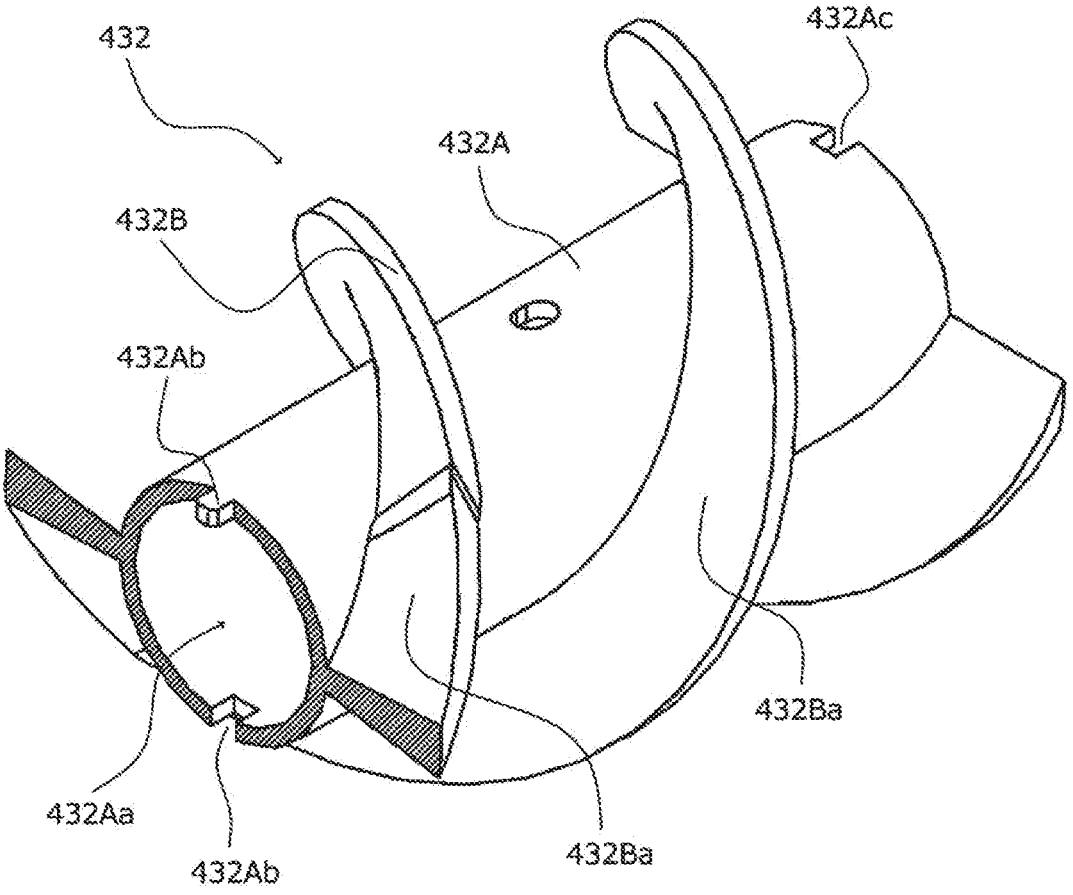
FIG. 5 is a perspective view illustrating a configuration of a blade member.
Figure 6A:
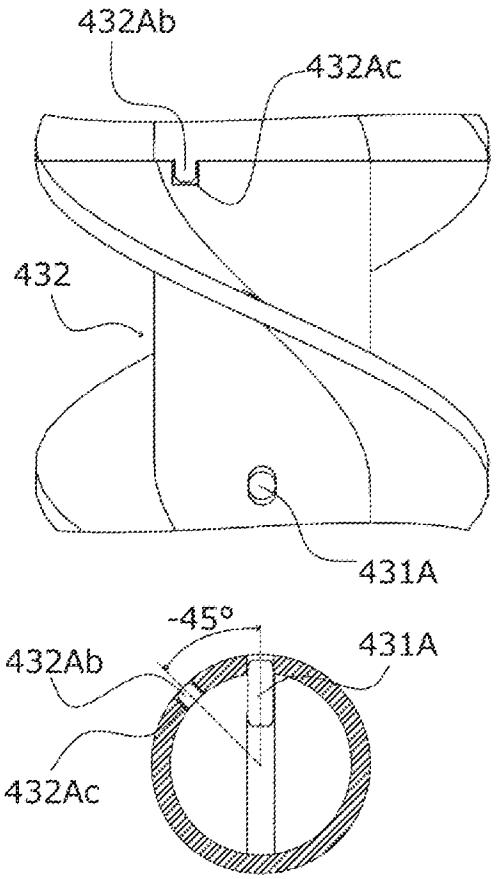
FIGS. 6A to 6C are views illustrating how the blade member is attached to a rotation shaft.
Figure 6B:
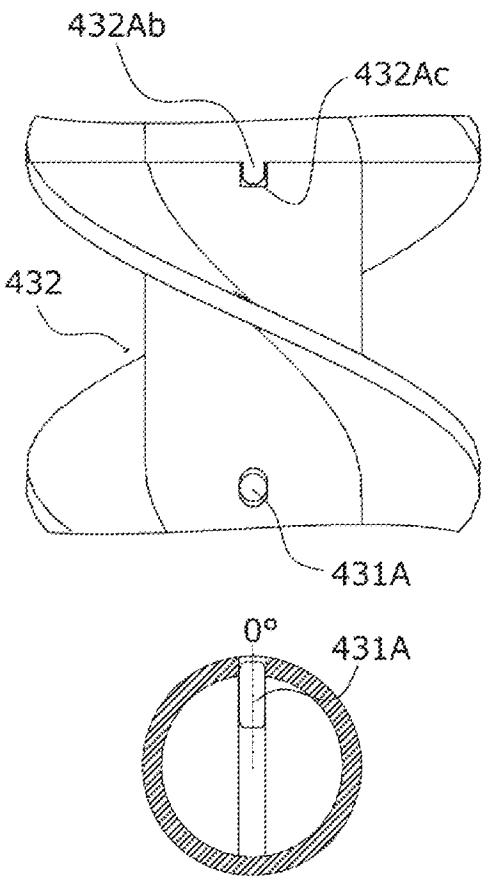
Figure 6C:
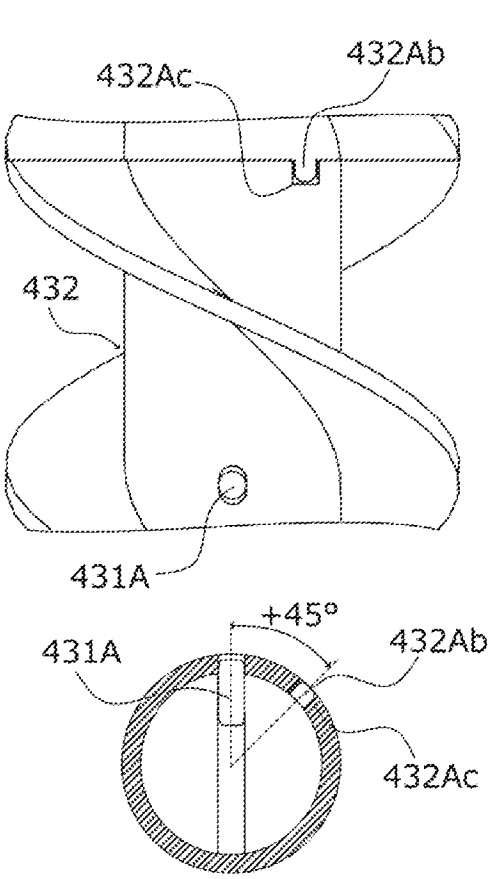
Figure 7:
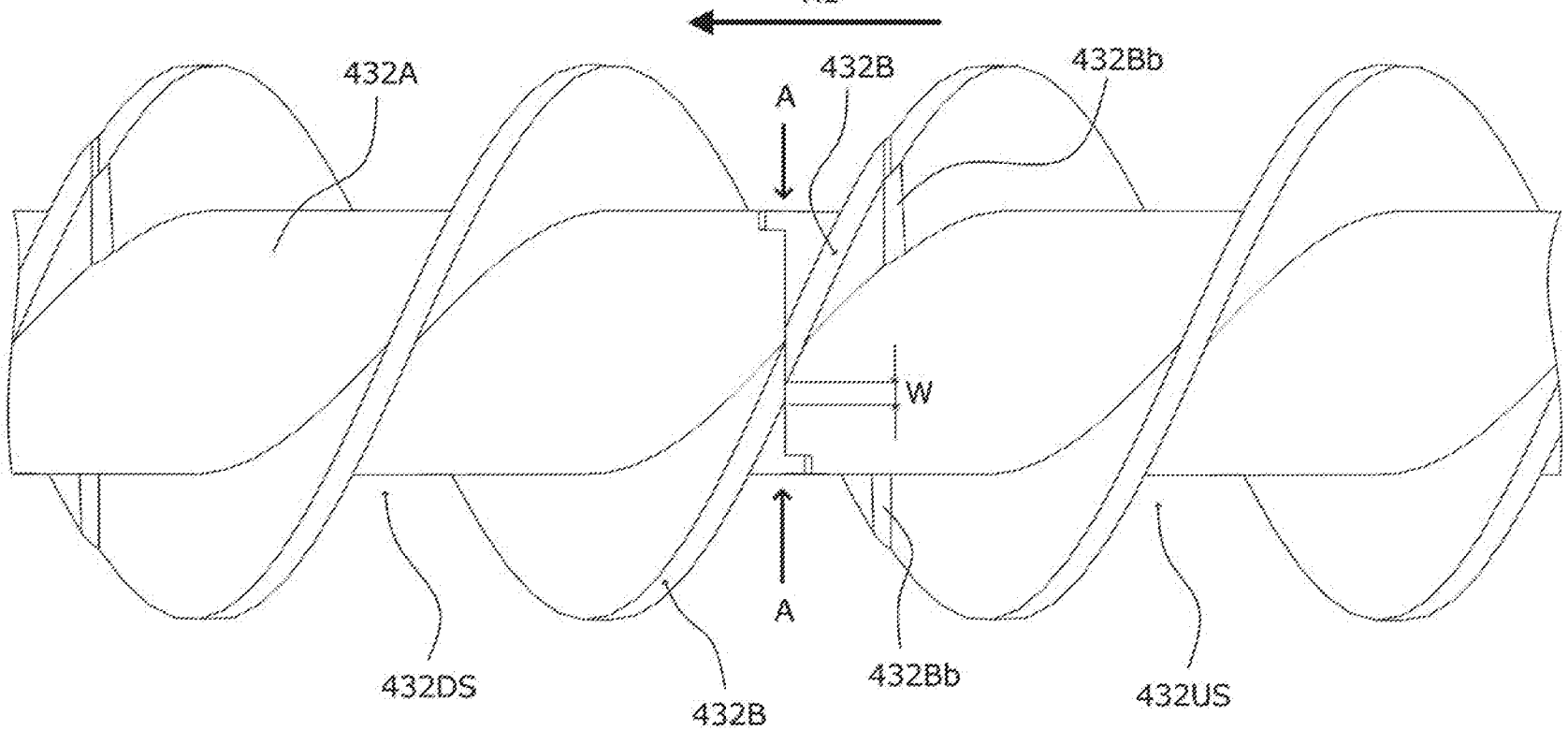
FIG. 7 is a view illustrating a phase shift at a joint between spiral blades of the blade members and a shape that the spiral blade has such that a phase of the spiral blade is shifted.
Figure 8:
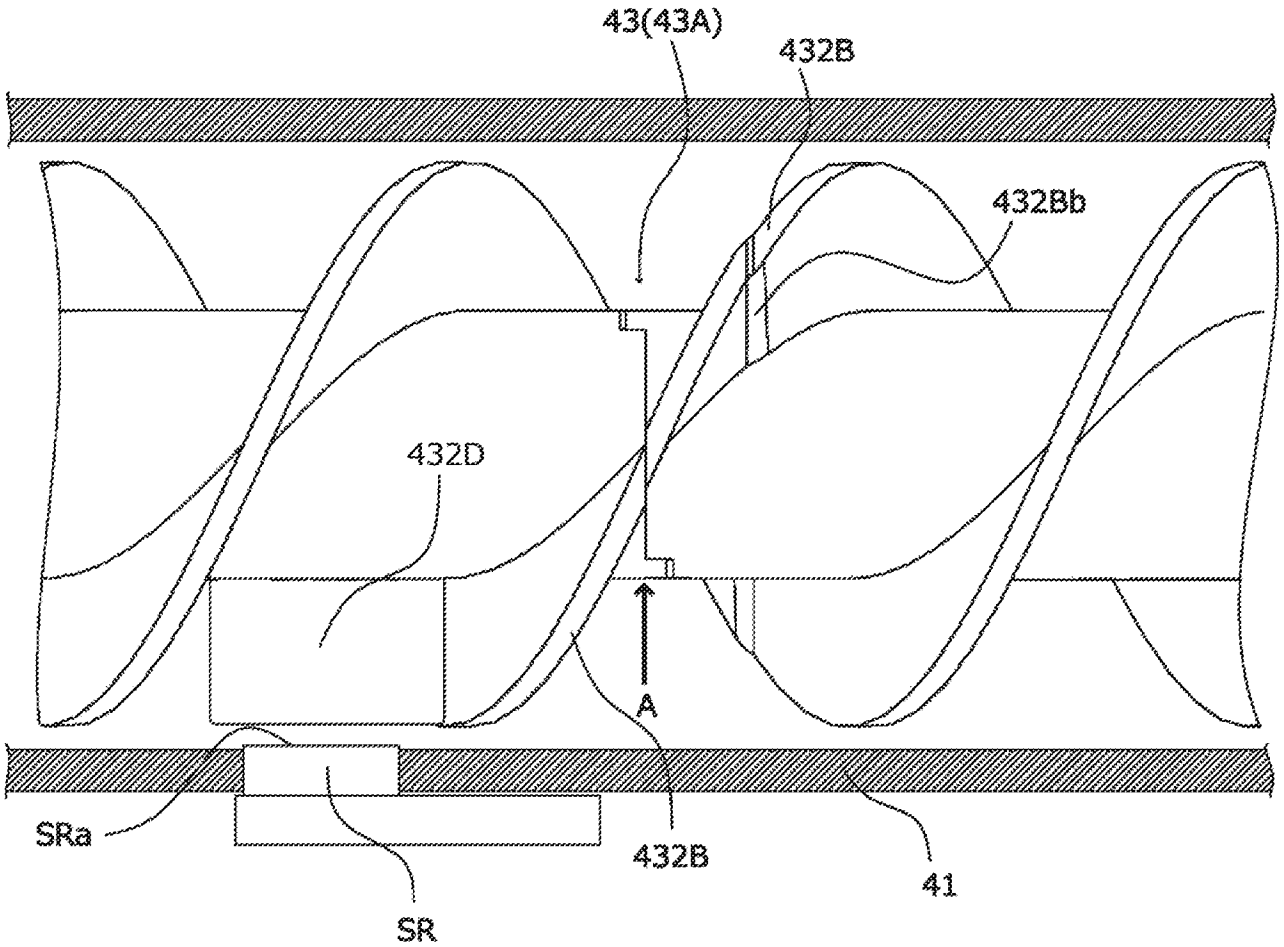
FIG. 8 is a view illustrating an attachment position of an ATC sensor.

FIG. 4 is a perspective view illustrating a configuration of the powder transport device 43. FIG. 5 is a perspective view illustrating a configuration of a blade member 432. FIGS. 6A to 6C are views illustrating how the blade member 432 is attached to a rotation shaft 431. FIG. 7 is a view illustrating a phase shift at a joint between spiral blades 432B of the blade member 432 and a shape that the spiral blade 432B has such that a phase of the spiral blade 432B is shifted. FIG. 8 is a view illustrating an attachment position of the ATC sensor. Hereinafter, the configuration of the agitation auger 43A and the supply auger 43B will be described as the powder transport devices 43.

FIG. 4 illustrates a part of the powder transport device 43 in which the plural blade members 432 are attached to the rotation shaft 431. As illustrated in FIG. 4, the powder transport device 43 includes the rotation shaft 431 and the plural blade members 432 detachably attached to the rotation shaft 431.

As illustrated in FIG. 5, the blade member 432 includes cylindrical portion 432A and the spiral blade 432B. A through hole 432Aa is formed in the cylindrical portion 432A. The spiral blade 432B is formed on an outer peripheral surface of the cylindrical portion 432A. The blade member 432 rotates together with the rotation shaft 431, to transport the developer with a side surface 432Ba of the spiral blade 432B along an axial direction of the rotation shaft 431. The developer is an example of powder.

A protrusion 432Ab is formed at one end portion of the cylindrical portion 432A of the blade member 432. A recess 432Ac is formed at the other end portion of the cylindrical portion 432A of the blade member 432. The protrusions 432Ab and the recesses 432Ac of each blade member 432 are fitted to the protrusions of 432Ab and the recesses 432Ac of adjacent blade members 432, so that each blade members 432 is positioned with respect to the rotation shaft 431 in the rotation direction, and the spiral blades 432B formed in the blade members 432 are continuous in the axial direction of the rotation shaft 431.

In a state where the blade members 432 are positioned with respect to the rotation shaft 431 in the rotation direction by fitting the protrusions 432Ab and the recesses 432Ac to each other, the blade members 432 are fixed with fixing tools 431A. The fixing tool 431A is an example of a fixing member. In the present exemplary embodiment, the fixing tool 431A is a slotted set screw or a parallel pin. As illustrated in FIGS. 6A, 6B, and 6C, the protrusion 432Ab and the recess 432Ac are formed within a region of ±45 degrees in the rotational direction of the rotation shaft 431 with respect to the fixing tool 431A. With this configuration, when the blade member 432 is fixed to the rotation shaft 431 with the fixing tool 431A, an operator can check with his or her eyes if the protrusion 432Ab and the recess 432Ac are fitted to each other.

In this way, in the powder transport device 43, the plural blade members 432 each including the spiral blade 432B which transports the powder along the axial direction of the rotation shaft 431 are attached such that the spiral blades 432B are continuous to each other in the axial direction of the rotation shaft 431. Accordingly, the size per blade member can be reduced as compared with a case where a single blade member is provided.

As illustrated in FIG. 7, the blade members 432 are fixed such that a phase of a spiral blade 432B of a downstream blade member 432DS in the transport direction of the developer (indicated by an arrow R1 in FIG. 7) among adjacent blade members 432 is shifted at a joint (indicated by an arrow A in FIG. 7) between the spiral blades 432B to advance in the transport direction (as indicated by W in FIG. 7). Accordingly, even when the blade member 432 fixed to the rotation shaft 431 with the fixing tool 431A is displaced by a distance corresponding to a clearance generated by the fitting between the protrusion 432Ab and the recess 432Ac in the rotation direction, due to the resistance of the developer, during rotation of the powder transport device 43 in the developer, a deviation between the spiral blades 432B can be prevented.

As illustrated in FIG. 7, each blade member 432 has a shape 432Bb such that a phase of a spiral blade 432B of a blade member 432US upstream of the joint (indicated by the arrow A in FIG. 7) between the spiral blades 432B in the transport direction (indicated by the arrow R1 in FIG. 7) of the developer among the adjacent blade members 432 is shifted.

With this configuration, a spiral blade 432BA that is the spiral blade 432B of the single blade member 432 before its phase is shifted in the transport direction f the developer and a spiral blade 432BB that is the spiral blade 432B of the single blade member 432 after its phase is shifted in the transport direction of the developer are continuous without a gap. Thus, it is possible to prevent the transportability of the powder from changing at the portion of the shape 432Bb which shifts the phase of the spiral blade 432B.

In the developing device 14, when the powder transport device 43 rotates, the spiral blade 432B periodically approaches a detection surface SRa of the ATC sensor SR, so that the output of the ATC sensor SR changes periodically. In addition to the spiral blade 432B, a paddle 432D is provided that extends from the blade member 432 toward the outer circumference. The paddle 432D presses the developer against the detection surface SRa to reduce the influence on the change in the developer amount in the developing device 14.

As illustrated in FIG. 8, in the developing device 14 according to the present exemplary embodiment, the ATC sensor SR is disposed at the OUT side of the powder transport device 43 (the agitation auger 43A) and at a position where the ATC sensor SR faces neither the joint A between the spiral blades 432B of the blade members 432 nor the shape 4323*b* which shifts the phase of the spiral blade 432B. With this configuration, the influence on the detection value of the ATC sensor SR can be reduced.

(2.3) Operation of Powder Transport Device

Figure 9A:
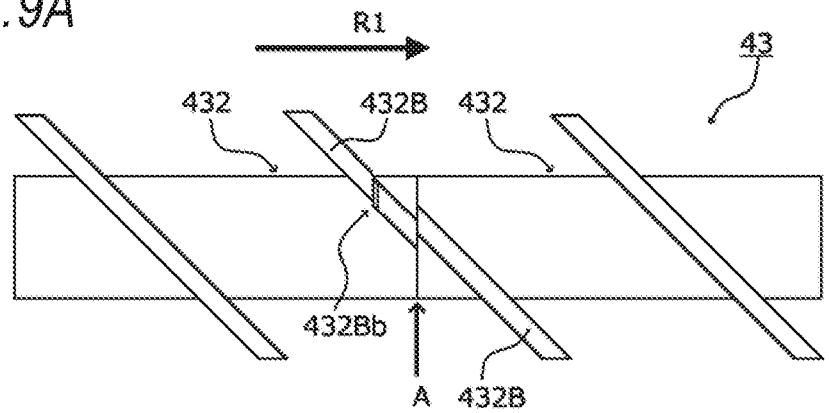
FIGS. 9A to 9C are schematic views illustrating how the powder transport device according to the present exemplary embodiment transports the developer.
Figure 9B:
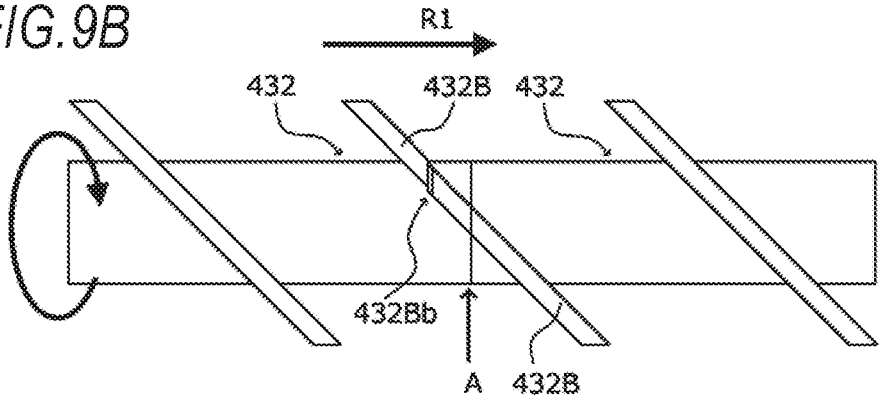
Figure 9C:
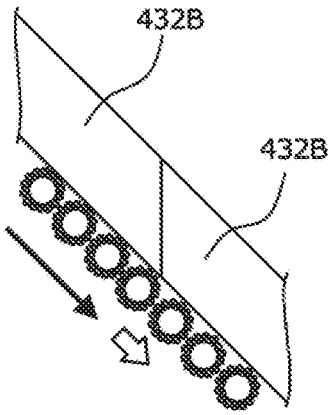
Figure 10A:
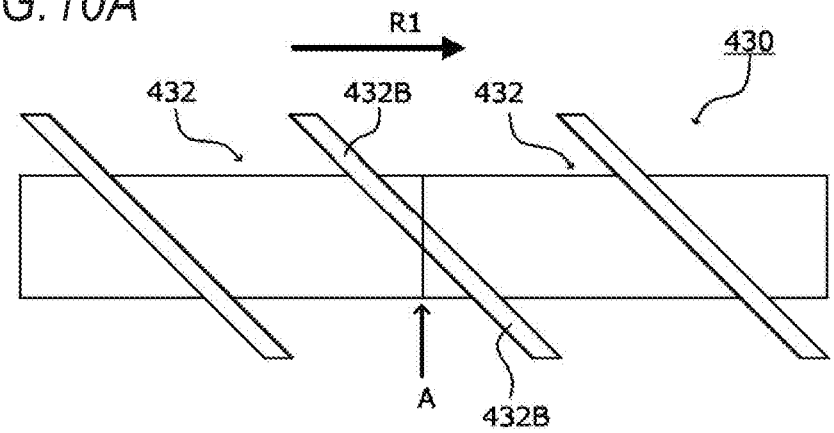
FIGS. 10A to 10C are schematic views illustrating how a powder transport device of a comparative example transports a developer.
Figure 10B:
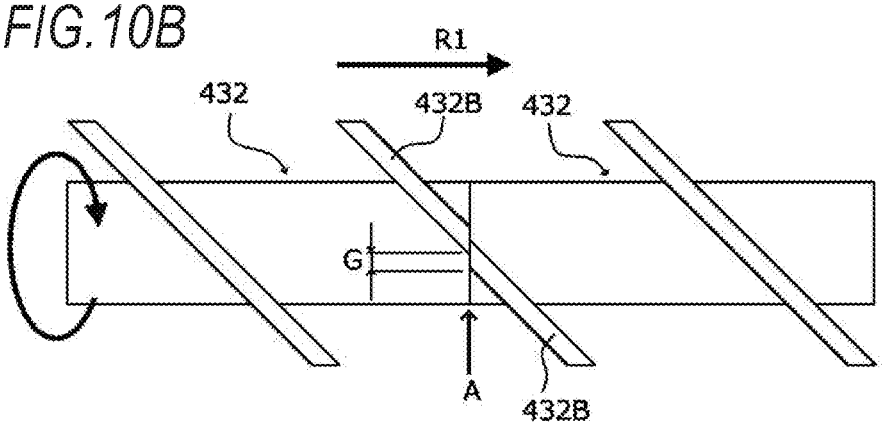
Figure 10C:
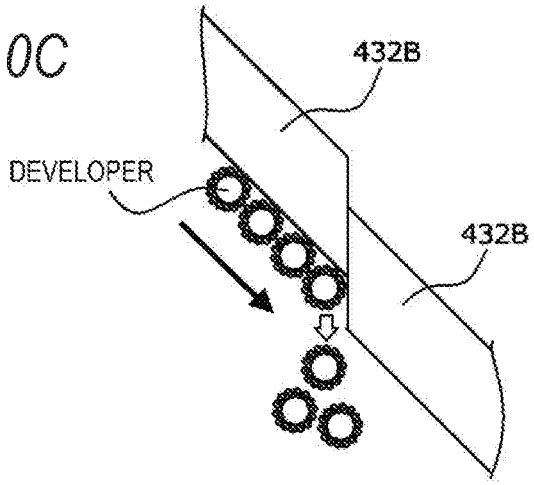

FIGS. 9A to 9C are schematic views illustrating how the powder transport device 43 according to the present exemplary embodiment transports the developer. FIGS. 10A to 10C are a schematic view illustrating how a powder transport device 430 of a comparative example transports the developer.

The operation of the powder transport device 43 to transport the developer will be described below with reference to the drawings.

FIG. 10A schematically illustrates the powder transport device 430 of the comparative example in which adjacent blade members 432 are fixed without shifting their phases at a joint (indicated by an arrow A in FIG. 10A) between the spiral blades 432B.

When the powder transport device 430 of the comparative example is driven to rotate, as illustrated in FIG. 10B, the blade member 432 may be deviated by a distance corresponding to the clearance generated by the fitting between the protrusion 432Ab and the recess 432Ac (see FIGS. 5 and 6) and thus, the phase of the spiral blade 432B adjacent to the joint between the spiral blades 4329 (indicated by an arrow A in FIG. 10B) may be shifted to generate a step G.

When the developer is transported in a state in which the phase of the adjacent spiral blade 432B is shifted and the step G is generated at the joint between the spiral blades 432B as illustrated in FIG. 10B, a part of the developer transported by the upstream spiral blade 432B in the transport direction of the developer may be rotated with going on the gap G, so that the developer may be scattered as schematically illustrated in FIG. 10C.

FIG. 9A schematically illustrates the powder transport device 43 according to the present exemplary embodiment in which the phase of the spiral blade 432B of the downstream blade member 432 in the transport direction of the developer among the adjacent blade members 432 is shifted at the joint (indicated by an arrow A in FIG. 9A) between the spiral blades 432B to advance in the transport direction and is fixed.

When the powder transport device 43 is driven to rotate, the blade members 432 may be deviated by the distance corresponding to the clearance generated by the fitting between the protrusion 432Ab and the recess 432Ac (see FIGS. 5 and 6) as illustrated in FIG. 9B, but no step G is generated between the adjacent spiral blades 432B in the joint (indicated by the arrow A in FIG. 9B) between the spiral blades 432B. As a result, as schematically illustrated in FIG. 9C, the developer transported by the upstream spiral blade 432B in the transport direction of the developer is smoothly passed to the downstream spiral blade 432B without being scattered.

The shape 432Bb is provided such that the phase of the spiral blade 432B of the blade member 432 upstream of the joint (indicated by the arrow A in FIG. 9B) between the spiral blades 432B in the transport direction (indicated by the arrow R1 in FIG. 9B) of the developer among the adjacent blade members 432 is shifted. Therefore, as schematically illustrated in FIG. 9C, the developer transported by the upstream spiral blade 432B easily goes over the joint between the spiral blades 432B and is smoothly passed to the downstream spiral blade 432B. Particularly, it is possible to prevent the transportability of the developer from changing at the portion of the shape 432Bb of the spiral blade 432B.

It is noted that it is not necessary to provide the shift shape 432Bb in the blade member 432, if the phase of the spiral blade 432B of the downstream blade member 432 in the transport direction of the developer among the adjacent blade members 432 is shifted at the joint between the spiral blades 432B to advance in the transport direction and is fixed. For example, the length of the spiral blade 432B may be designed such that a phase at one end portion of the spiral blade 432B provided in a single blade member 432 is different from a phase at the other end portion of the spiral blade 432B provided in the single blade member 432, and the blade member 432 may be manufactured based on this design.

In the present exemplary embodiment, the agitation auger 43A and the supply auger 43B used to transport the developer in the developing device 14 of the image forming apparatus 1 have been described as specific examples of the powder transport device 43. The powder transported by the powder transport device 43 may be inorganic material powders or organic material powders for use in various technical fields such as an electronic field, an energy field, a medical field, and a food field, for example, powders of fine ceramics, metal materials, polymer materials, battery materials, electronic materials, composite materials, pharmaceutical materials, or food materials.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder transport device comprising:

a rotation shaft rotatably supported in a container chamber that contains powder; and a plurality of blade members detachably attached to the rotation shaft, the blade members including spiral blades configured to transport the powder in an axial direction of the rotation shaft in response to the rotation shaft rotating, wherein each of the plurality of blade members includes a cylindrical portion radially inward of the spiral blade, and each cylindrical portion is integrally formed with a corresponding one of the plurality of blades, wherein the blade members have a shape such that a phase of a spiral blade of a blade member upstream of a joint between the spiral blades in a transport direction of the powder among adjacent blade members of the plurality of blade member, is shifted, and wherein a detector configured to detect the powder is not disposed at a position where the detector faces the shape which shifts the phase of the spiral blade, in the container chamber.

2. The powder transport device according to claim 1, wherein the spiral blades are attached to the blade members such that the spiral blades are continuous to each other in the axial direction of the rotation shaft.

3. A developing device comprising:

the powder transport device according to claim 2;

the container chamber that contains a toner;

a developing roller configured to receive the toner contained in the container chamber, and pass the toner to an image forming device, wherein the powder transport device is provided in the container chamber, and the powder transport device is configured to transport the toner as the powder.

4. An image forming apparatus comprising:

the developing device according to claim 3; and the image forming device configured to form an image on a recording medium with the toner.

5. The powder transport device according to claim 1, wherein the plurality of blade members include adjacent blade members, one of adjacent blade members has a protrusion, the other of the adjacent blade members has a recess, and the protrusion and the recess are fitted to each other.

6. A developing device comprising:

the powder transport device according to claim 5;

the container chamber that contains a toner;

a developing roller configured to receive the toner contained in the container chamber, and pass the toner to an image forming device, wherein the powder transport device is provided in the container chamber, and the powder transport device is configured to transport the toner as the powder.

7. An image forming apparatus comprising:

the developing device according to claim 6; and the image forming device configured to form an image on a recording medium with the toner.

8. The powder transport device according to claim 1, wherein a phase of a spiral blade of a blade member downstream in a transport direction of the powder among adjacent blade members of the plurality of blade members, is shifted at a joint between the spiral blades to advance in the transport direction and is fixed.

9. The powder transport device according to claim 8, wherein a detector configured to detect the powder is not disposed at a position where the detector faces the joint between the spiral blades in the container chamber.

10. A developing device comprising:

the powder transport device according to claim 8;

the container chamber that contains a toner;

a developing roller configured to receive the toner contained in the container chamber, and pass the toner to an image forming device, wherein the powder transport device is provided in the container chamber, and the powder transport device is configured to transport the toner as the powder.

11. A developing device comprising:

the powder transport device according to claim 1;

the container chamber that contains a toner;

a developing roller configured to receive the toner contained in the container chamber, and pass the toner to an image forming device, wherein the powder transport device is provided in the container chamber, and the powder transport device is configured to transport the toner as the powder.

12. An image forming apparatus comprising:

the developing device according to claim 11; and the image forming device configured to form an image on a recording medium with the toner.

13. A powder transport device comprising: a rotation shaft rotatably supported in a container chamber that contains powder;

a plurality of blade members detachably attached to the rotation shaft, the blade members including spiral blades configured to transport the powder in an axial direction of the rotation shaft in response to the rotation shaft rotating; and fixing members that fix the blade members to the rotation shaft, wherein the plurality of blade members include adjacent blade members, one of adjacent blade members has a protrusion, the other of the adjacent blade members has a recess, the protrusion and the recess are fitted to each other, and the protrusion and the recess are provided within a region of ±45 degrees in a rotation direction of the rotation shaft with respect to the fixing members.

14. A developing device comprising:

the powder transport device according to claim 13;

the container chamber that contains a toner;

a developing roller configured to receive the toner contained in the container chamber, and pass the toner to an image forming device, wherein the powder transport device is provided in the container chamber, and the powder transport device is configured to transport the toner as the powder.

15. An image forming apparatus comprising:

the developing device according to claim 14; and the image forming device configured to form an image on a recording medium with the toner.

* * * * *